US007321528B2

(12) United States Patent
Wiederrecht et al.

(10) Patent No.: US 7,321,528 B2
(45) Date of Patent: Jan. 22, 2008

(54) WATCH MOVEMENT

(75) Inventors: Jean-Marc Wiederrecht, 40, Chemin du Guillon, Genéve (CH); Saskia Bouvier, Chancy (CH)

(73) Assignee: Jean-Marc Wiederrecht, Bernex (CH)

( * ) Notice: Subject to any disclaimer, the term of this patent is extended or adjusted under 35 U.S.C. 154(b) by 0 days.

(21) Appl. No.: 10/528,995

(22) PCT Filed: Mar. 13, 2002

(86) PCT No.: PCT/CH02/00151

§ 371 (c)(1),
(2), (4) Date: Mar. 14, 2005

(87) PCT Pub. No.: WO02/075461

PCT Pub. Date: Sep. 26, 2002

(65) Prior Publication Data

US 2005/0219959 A1 Oct. 6, 2005

(30) Foreign Application Priority Data

Mar. 20, 2001 (EP) ..... 0810282

(51) Int. Cl.
*G04B 19/02* (2006.01)

(52) U.S. Cl. ..... 368/220; 368/323

(58) Field of Classification Search ..... 368/28, 368/37, 76, 88, 223, 228, 276, 278, 10, 220, 368/323

See application file for complete search history.

(56) References Cited

U.S. PATENT DOCUMENTS 1,949,024 A 2/1934 Melik-Minassiantz ..... 58/126
2,636,283 A * 4/1953 Dinstman ..... 33/348
2,852,908 A * 9/1958 Stern et al. ..... 368/77
3,029,592 A * 4/1962 Bandi ..... 368/139
4,090,352 A * 5/1978 Jeannet et al. ..... 368/220
4,241,438 A * 12/1980 Kern ..... 368/185
4,364,671 A * 12/1982 Fluck ..... 368/221
4,473,304 A * 9/1984 Ketner ..... 368/281
4,525,077 A * 6/1985 Ketner ..... 368/77
6,052,338 A * 4/2000 Shevins ..... 368/223

FOREIGN PATENT DOCUMENTS

FR 2713790 6/1995
GB 2162663 2/1986

* cited by examiner

*Primary Examiner*—Vit Miska
*Assistant Examiner*—Jeanne-Marguerite Goodwin
(74) *Attorney, Agent, or Firm*—Townsend M. Belser, Jr.; Nexsen Pruet, LLC

(57) ABSTRACT

The invention relates to a watch movement comprising an annular casing (10), having an external diameter D, which is provided with a central round opening (48) that is defined by an internal diameter d. According to the invention, the gear train (34) comprises a mobile (36) consisting of a minute wheel (36*a*) and a pinion (36*b*), a cannon pinion (38), which is driven by the minute wheel (36*a*) and intended to support a minute hand (40), and an hour wheel (42) which is driven by the pinion (36*b*) and intended to support an hour hand (44). The cannon pinion (38) and the hour casing (10) and are provided with a central opening that is more or less equal to d. The minute wheel (36*a*) is provided with a diameter that is slightly smaller than (D−d)/2.

25 Claims, 5 Drawing Sheets

WATCH MOVEMENT

The present invention relates to watch movements, of the type comprising an annular frame, of external diameter D, provided with a round central opening defined by an internal diameter d and, borne by said frame:

an energy source, a time base, a counting device actuated in synchronization with the time base, a work train actuated by the counting device, a motion work train, arranged to bear analog time display means, and correcting means for the display means.

Such a movement is described in document WO 99/35542. It is disposed in a case provided with a central hole, which lends the watch a particular appearance. In this movement, the display is realized by means of two disks placed one on top of the other, one provided with an internal toothing and displaying the hours, the other with an external toothing and displaying the minutes, and both driven by pinions belonging to one of the movement trains.

Another movement of this type forms the subject of document EP 0 681 227. It comprises, in a similar manner, two disks displaying the hours and the minutes, but disposed in one and the same plane. In this movement, the central part, which is thus freed, allows the accommodation of a tourbillon.

Documents FR 2 713 790 and GB 2 162 663 also relate to watches of this type. In these watches, the gear trains and the correcting means are disclosed very sketchily, the description confining itself to specifying that use is made of a mechanism of known type.

The fact of possessing an opening in the center of the movement permits some original design solutions, both from the technical and from the esthetic viewpoint, but the use of disks makes reading of the time less comfortable and less easy. Moreover, the driving of these disks is effected by means of gears, which adds to the number of mobiles moved by the energy source, thereby increasing friction-induced losses.

The object of the present invention is to alleviate these drawbacks. This object is achieved by virtue of the fact that the motion work train comprises a motion work mobile containing a wheel and a pinion, a cannon pinion driven by the motion work wheel and intended to bear a minute hand, and an hour wheel driven by the motion work pinion and intended to bear an hour hand. Moreover, the cannon pinion and the hour wheel are concentric to the frame and have a central opening substantially equal to d and the motion work wheel has a diameter slightly less than (D−d)/2.

Admittedly, timepieces are known in which the motion work wheel is large in size compared with the area of the dial, extending practically as far as the periphery of the movement. This is the case with the timepiece disclosed in document U.S. Pat. No. 1,949,024 in which a timepiece movement, belonging to a clock, is disclosed very sketchily, to explain the operation of a display of a novel type. In that timepiece, the center of the movement is closed and occupied by the first wheel shaft, which makes one revolution per hour.

Advantageously, the work train contains a first mobile provided with a spindle on which the motion work mobile is friction-mounted.

The correcting means for the display means contain a gear which mates directly with the cannon pinion.

The annular shape of the frame allows the mobiles of the work train to be arranged in such a way that their rotation axes are substantially disposed on a circle of diameter equal to (D+d)/2.

Such a solution is particularly well suited to mechanical-type movements, in which the energy source is formed by a barrel, the time base by a balance, the counting device by an escapement, the barrel and the balance pivoting on axes substantially disposed on this circle.

The central opening allows numerous uses, for example the display of complementary information. In a particularly advantageous variant, the movement comprises a date mechanism, disposed on the side opposite the dial, containing two display disks, one for tens, the other for units, the date appearing in the opening. It is thus possible to display the date with particularly large digits.

In order to ensure correct positioning of the display means, the cannon pinion and the hour wheel each comprises a tubular portion, engaged one within the other, the tubular portion of the cannon pinion being positioned in the central opening such as to be able to rotate freely therein.

In a first embodiment, the motion work mobile and the toothings of the cannon pinion and of the hour wheel are disposed on the bottom side of the frame. The tubular portion of the cannon pinion is defined by an internal diameter and by an external diameter, the external diameter being slightly less than d, so allowing it to rotate freely in the opening, whereas the tubular portion of the hour wheel is defined by an external diameter slightly less than the internal diameter of the tubular portion of the cannon pinion, such that the hour wheel can rotate freely therein.

It is possible to use the tubular portion of the hour wheel as accommodation for an object, the latter being able to have a technical function, such as a lens or a compass, or an esthetic function, such as a precious stone.

In a second embodiment, the motion work mobile and the toothings of the cannon pinion and of the hour wheel are disposed on the dial side of the frame. In this case, the tubular portion of the cannon pinion is defined by its external diameter, a first part of which is engaged in the opening, the external diameter being slightly less than d, so allowing it to rotate freely in the opening, and a second part of which, disposed outside the opening, is intended to bear the minute hand and has the hour wheel engaged on it.

It is possible to use the tubular portion of the cannon pinion as accommodation intended for the reception of an object, the latter being able to have a technical function, such as a lens or a compass, or an esthetic function, such as a precious stone.

Other advantages and characteristics of the invention can be gleaned from the following description, given with reference to the appended drawing, in which.

Figure 1:
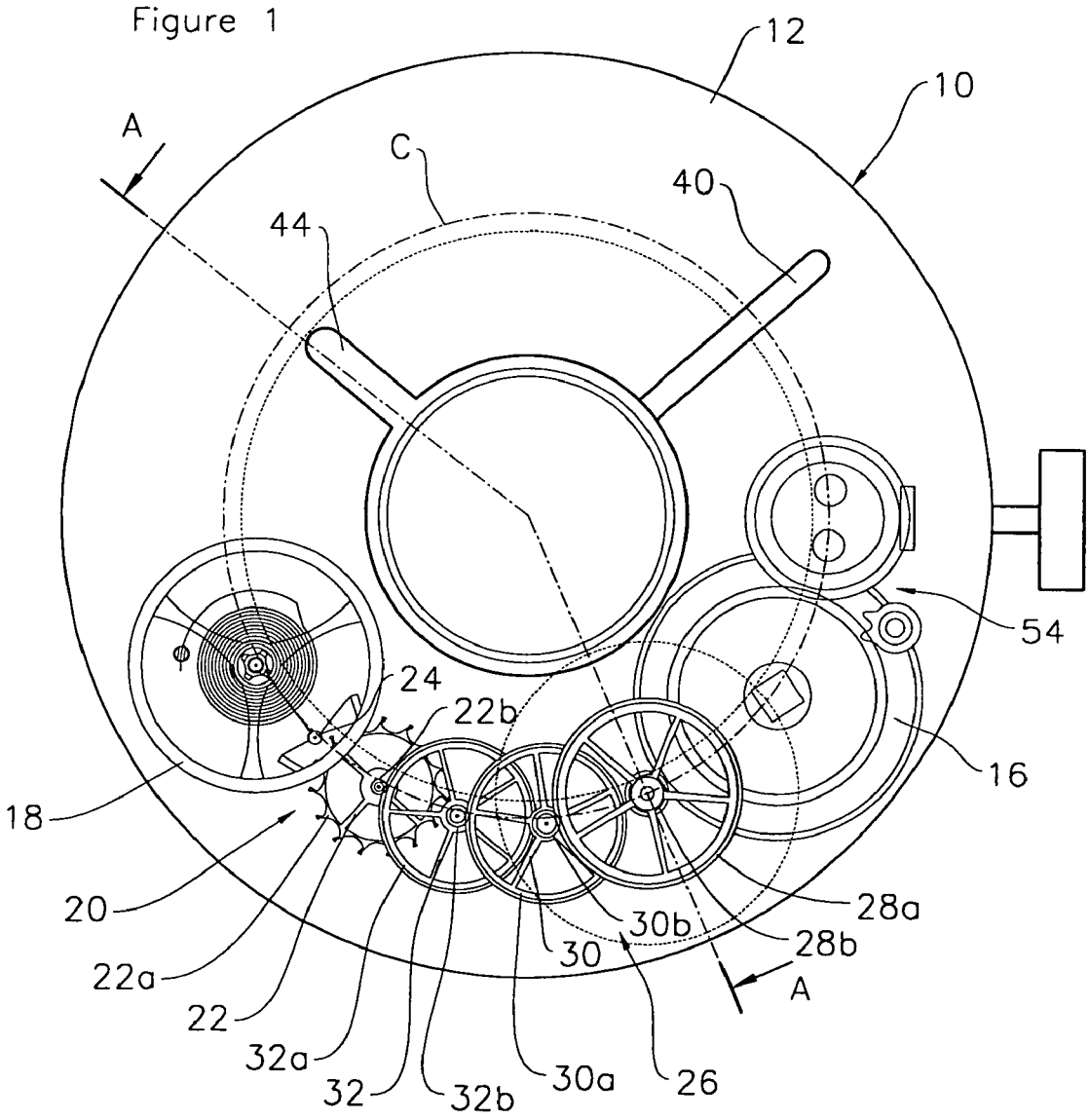
FIGS. 1, 2 and 3 represent a movement according to a first embodiment of the invention, respectively showing the dial side, the bottom side and a sectional view along the line A-A of FIGS. 1 and 2.
Figure 2:
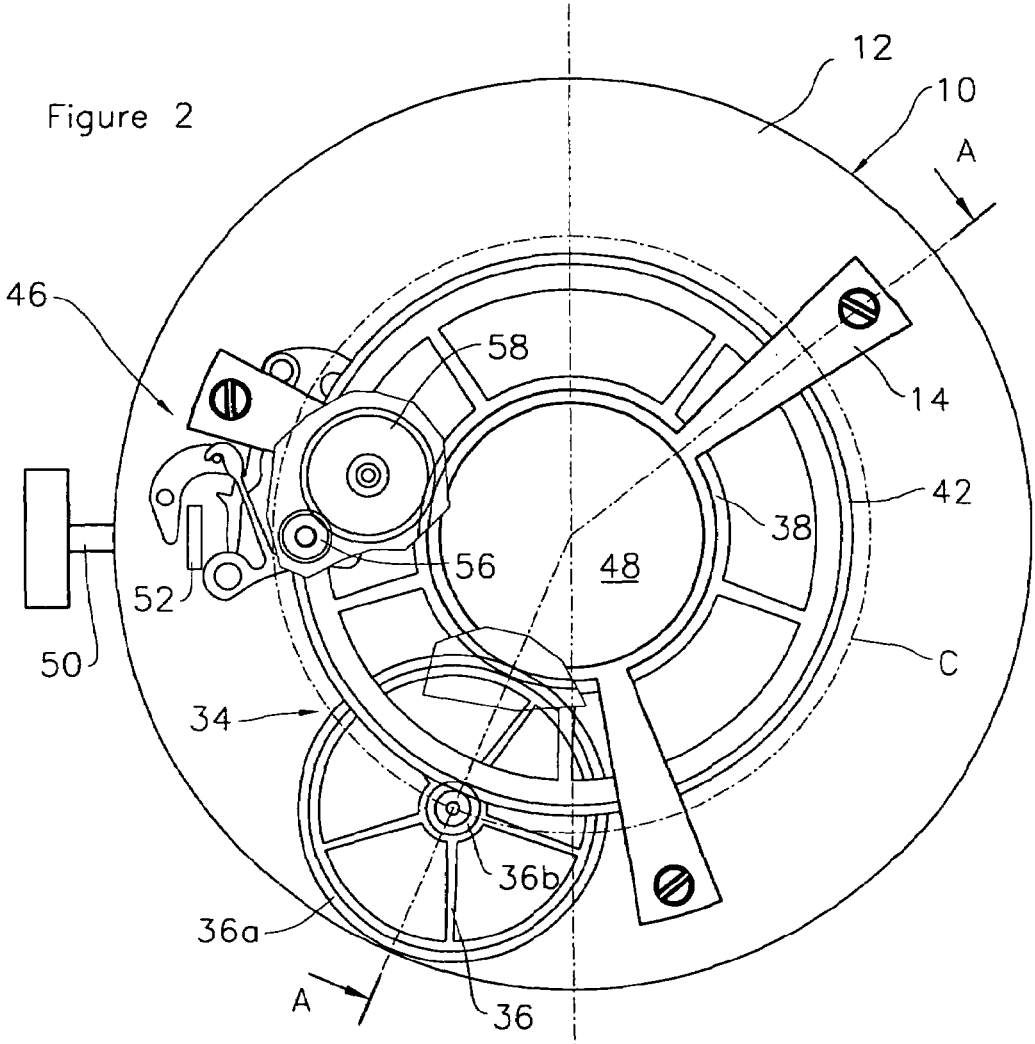
Figure 3:
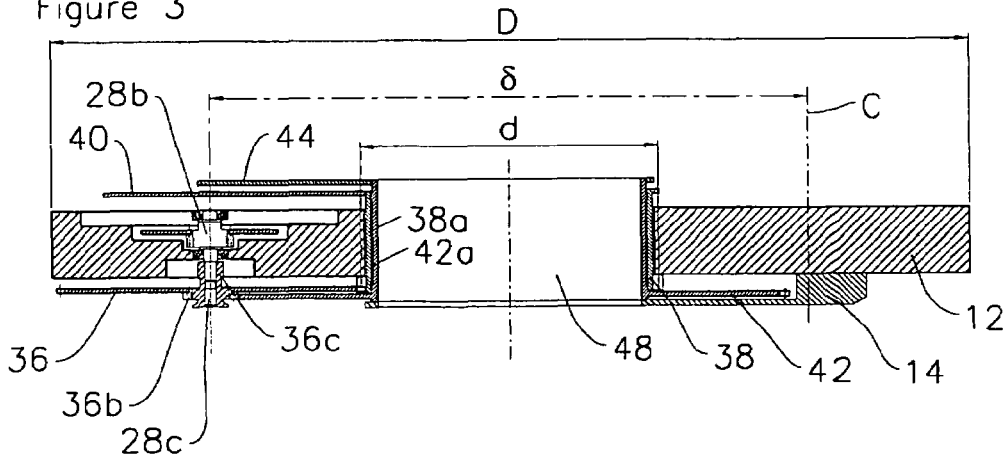

The movement represented in FIGS. 1 to 3 comprises, in the traditional manner, a frame 10 formed by a plate 12 and by bridges, only one of which, the switching bridge 14, is visible, in FIGS. 2 and 3. The frame 10 bears, as are visible in FIG. 1:

a barrel 16 taking the place of the energy source, a balance 18 providing for the working of the time base, an escapement 20 which provides for the counting of the time in synchronization with the balance and which comprises a mobile 22, containing a wheel 22*a* and a pinion 22*b*, and a pallet fork 24, a work train 26, containing a first mobile 28, a third wheel mobile 30, a seconds mobile 32, each mobile comprising a wheel identified by the letter a and a pinion b, in which the first pinion 28*b* is meshed with the barrel 16 and the seconds wheel 32*a* with the pinion 22*b* of the escapement mobile 22.

The frame 10 bears additionally, on the bottom and as represented in FIG. 2:

a motion work train 34 comprising a motion work mobile 36 formed by a wheel 36*a* and by a pinion 36*b*, a cannon pinion 38 driven by the motion work wheel 36*a* and intended to bear a minute hand 40, and an hour wheel 42 driven by the motion work pinion 36*b* and intended to bear an hour hand 44, the hands 40 and 44 being visible in FIGS. 1 and 3, and a winding and time-setting mechanism 46.

In this movement, the frame 10 has an annular shape, having an external diameter D and an internal diameter d, which defines a central opening 48. It is dimensioned such that D is slightly greater than 3d, typically within the range 3.1d to 3.3d.

The winding and time-setting mechanism 46 contains a time-setting stem 50, intended to be manipulated from the outside of the watch, a sliding pinion, not visible in the drawing, a winding pinion 52, these latter being mounted on the stem 50, as well as a winding train 54 comprising a crown wheel and a ratchet wheel and which links the winding pinion to the barrel 16 in order to load the spring of which said barrel consists (FIG. 1). The mechanism 46 additionally contains two gears 56 and 58 represented in FIG. 2, intermeshed and mating respectively with the sliding pinion and with the cannon pinion 38, as well as a setting lever, a yoke and a jumper bridge, which have not been referenced since they are not directly involved in the invention.

As can be seen in FIG. 1, the pivot axes of the barrel 16, of the mobiles of the work train 26 and of the escapement 20, as well as of the balance 18, are substantially disposed on a circle C, the diameter δ of which is substantially equal to (D+d)/2. All these mobiles are placed on the dial side of the plate 12. They are held in place by one or more bridges (not represented). This particular arrangement enables those components of the watch which have the most interesting esthetic characteristics to be made visible, beneath the dial.

As is shown more particularly in FIG. 3, the first pinion 28*b* is engaged in the plate 12 and comprises a spindle 28*c*, which extends beyond said plate and on which the motion work mobile 36 is mounted by its pinion 36*b*. The latter, tubular in shape, comprises indenting 36*c*, which cooperates with the spindle 28*c* to ensure a friction connection. This configuration has the effect that the motion work mobile 36 rotates with the first mobile 28, except during time-setting, when the motion work pinion 36*b* slides on the spindle 28*c* owing to the friction connection.

Although the work train mobiles pivot in a traditional manner between the plate 12 and one of the bridges, the axial and radial guidance of the cannon pinion 38 and of the hour wheel 42 is realized in an original manner. More precisely, the cannon pinion 38 contains a tubular portion 38*a*, the external diameter of which is slightly less than the internal diameter of the opening 48, so allowing it to rotate freely therein, and the length of which is sufficient to traverse the frame 10 and exceed a height which allows the minute hand 40 to be pressed in place.

The hour wheel 42 likewise contains a tubular portion 42*a*, the external diameter of which is slightly less than the internal diameter of the portion 38*a*, such that the hour wheel can be engaged in the cannon pinion and can rotate freely therein. The portion 42*a* is sufficiently high to extend beyond the portion 38*a* and allow the fixing of the hour hand 44.

Traditionally in timepieces, the minute hand 40 completes one revolution per hour and the hour hand one revolution every 12 hours. This means that the toothings of the motion work mobile 36, of the cannon pinion 38 and of the hour wheel 42 must be numbered such that the gears ratio is equal to 1/12.

Since the opening 48 has a diameter d substantially equal to D/3, this means that the width of the annular portion is substantially equal to d, corresponding to the space radially available to accommodate the motion work wheel 36*a*. In other words, the motion work wheel 36*a* and the cannon pinion 38 have the same diameter. That is tantamount to saying that, on the one hand, the motion work makes one revolution per hour, corresponding to the rotation speed of the first mobile, and that, on the other hand, the division by twelve must be effected between the motion work pinion 36*b* and the hour wheel 42, the gears ratio between these mobiles being 1:12. It will be noted that with this configuration the hour hand 44 is placed below the minute hand 40.

Figure 5:
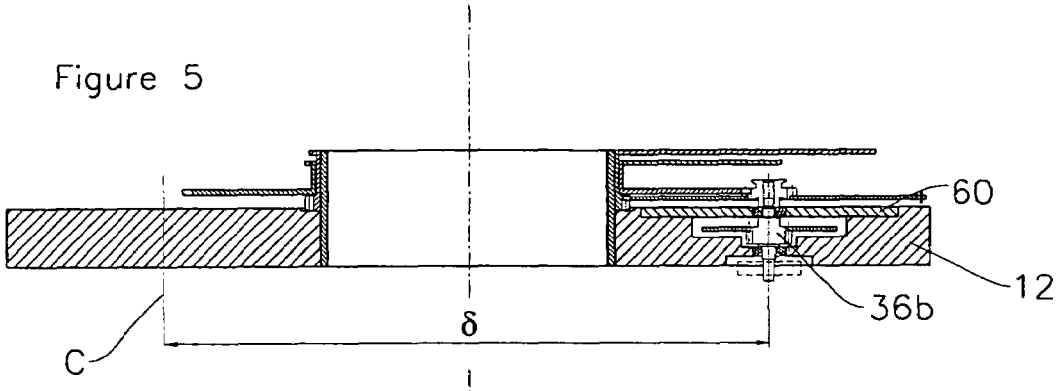
FIGS. 4 and 5 show a movement according to a second embodiment, respectively showing the bottom side and a sectional view along the line A-A of FIG. 4, and FIGS. 6 to 10 present five variants of watches provided with a movement according to the invention, in plan view in a and in enlarged partial section in b.

The embodiment represented in FIGS. 4 and 5 makes use of the majority of components described with reference to FIGS. 1 to 3, these components bearing the same references. In this case, however, both the work train 26 and the motion work train 34 are disposed on the dial side. The first pinion 36*b* pivots between the plate 12 and a bridge 60 visible only in FIG. 5.

The cannon pinion 38 also comprises a tubular portion 38*a*, formed by two distinct parts. The first part, which extends towards the bottom side, is engaged in the opening 48. The second part, which extends beyond the face of the frame on the dial side, constitutes a support for the minute hand 40. The hour wheel is also provided with a tubular portion 42*a*, but disposed on and surrounding the tubular portion 38*a* of the cannon pinion in its second part, and not engaged in the opening 48, as described in the first embodiment.

Such a variant allows the hour hand 44 and minute hand 40 to be traditionally positioned. Moreover, since a single tubular portion is engaged in the opening 48, the diameter thereof can be slightly larger.

One or other of the movements described above can be accommodated in a traditional case 61, as can be seen in FIGS. 6 to 10 showing different construction variants.

Figure 6:
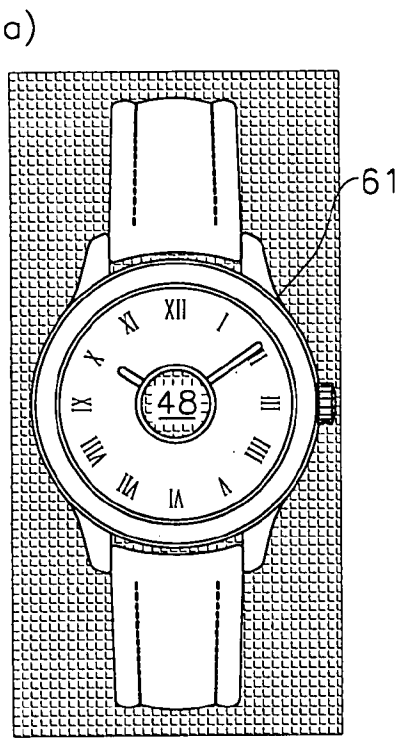

In the watch of FIG. 6, the opening 48 is simply left empty and the case 61 is provided with a bottom 62 made from glass, such that it is possible to see through the watch in its central part.

Figure 7:
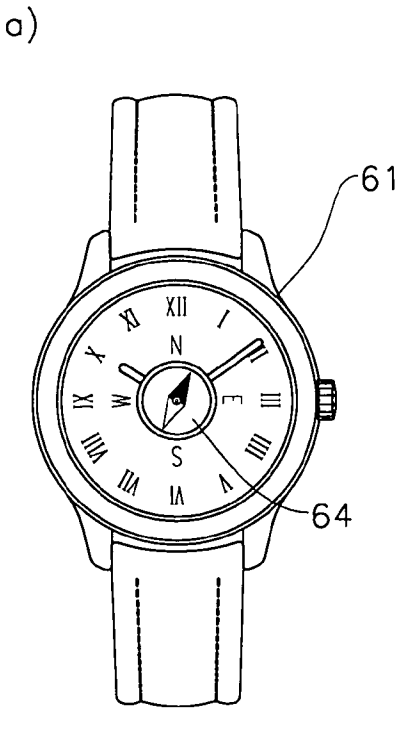
Figure 8:
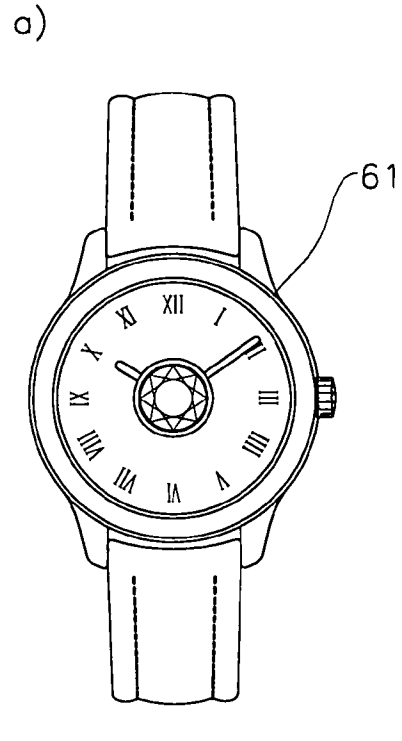
Figure 9:
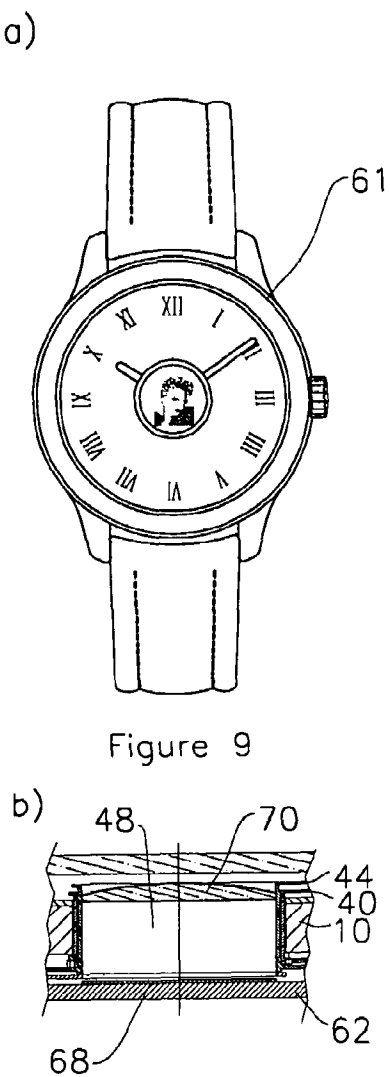

The opening 48 can also serve as receptacle for an object, as illustrated in FIGS. 7 to 9. Depending on whether the movement corresponds to the first or second embodiment described above, this object will be accommodated either in the tubular portion 42*a* of the hour wheel or in the tubular portion 38*a* of the motion work.

The object associated with the watch represented in FIG. 7 is a compass 64, which rotates with the wheel whose tubular part serves as accommodation. In this case, the bottom 62 can be opaque.

The variant of FIG. 8 uses the tubular portion serving as accommodation to receive a precious stone 66, for example a diamond or a zircon. Such a solution lends the watch a jeweled appearance, whilst preserving great sobriety. In this case, it is advantageous for the bottom 62 of the case 61, at least in its central part, to be transparent. That contributes to the luminosity of the precious stone.

FIG. 9 represents a watch in which the bottom 62 bears an image 68, which can be enlarged by means of a magnifier 70 borne by the tubular portion 38*a* or 42*a*.

Figure 10:
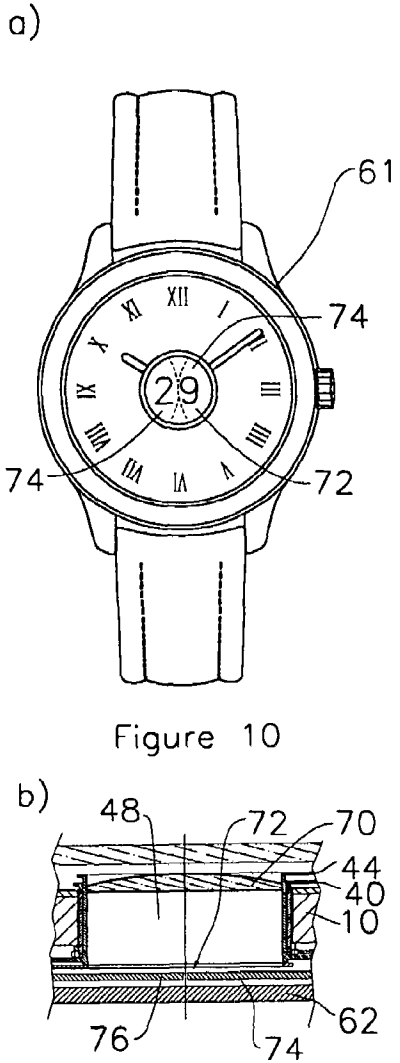

Finally, FIG. 10 relates to a watch similar to that of FIG. 9, the image being replaced by a large-windowed date display 72. This display is realized by means of two disks 74 and 76, one displaying units and the other tens, these two disks being driven by a mechanism such as that described in patent CH 310 559, for example.

The movements described with reference to FIGS. 1 to 5 are mechanical in type. It is clear that, in a totally comparable manner, the basic characteristics of the invention can be found in electromechanical watches. In this case, the energy source is a battery or storage battery, the time base a quartz, and the counting device an electronic circuit and a step motor.

Figure 4:
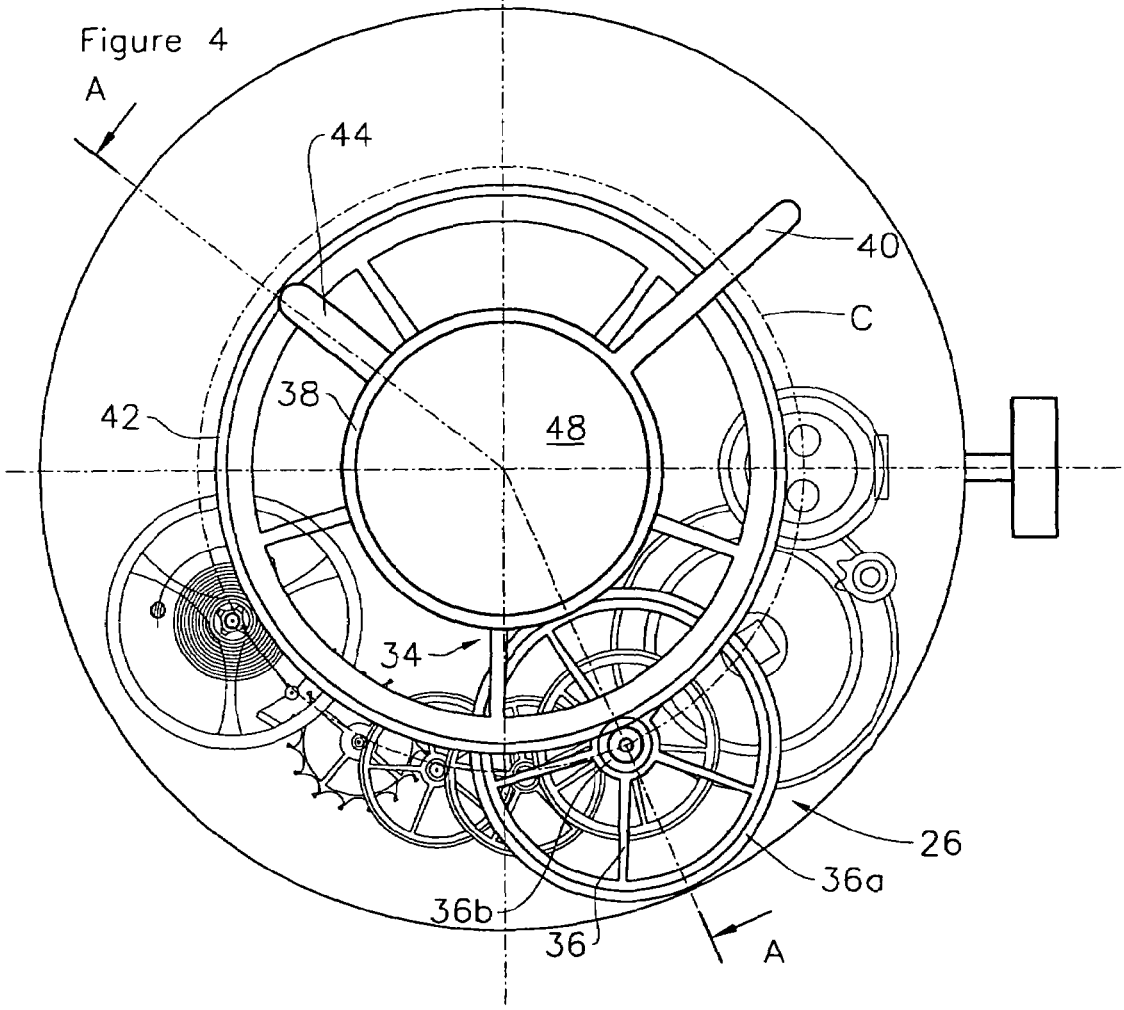

As can be seen in FIGS. 1, 2 and 4, the base components of the movement occupy essentially the portion of the frame 10 contained between 3 o'clock and 9 o'clock. The other parts of this frame 10 can serve as support for other mechanisms such as a repeater, a chronograph, etc. It would likewise be possible to dispose the work trains 26 and motion work trains 34 on the bottom side and to place a disks-type display device on the dial side, displaying, for example, the day and the date.

The invention claimed is:

1. A watch movement comprising an annular frame (10), of external diameter D, provided with a round central opening (48) defined by an internal diameter d and, borne by said frame:

an energy source (16), a time base (18), a counting device (20) actuated in synchronization with the time base (18), a work train (26) actuated by said device (20), a motion work train (34), arranged to bear analog time display means (40, 44), and correcting means (46, 50, 56, 58) for the display means (40, 44), characterized in that the motion work train (34) comprises a motion work mobile (36) containing a wheel (36*a*) and a pinion (36*b*), a cannon pinion (38) driven by the motion work wheel (36*a*) and intended to bear a minute hand (40), and an hour wheel (42) driven by the motion work pinion (36*b*) and intended to bear an hour hand (44), in that the cannon pinion (38) and the hour wheel (42) are concentric to the frame (10) and have a central opening substantially equal to d, and in that the work train contains a first mobile (28) provided with a spindle (28*c*) on which the motion work mobile (36) is friction-mounted.

2. The movement as claimed in claim 1, characterized in that the work train contains a first mobile (28) provided with a spindle (28*c*) on which the motion work mobile (36) is friction-mounted.

3. The movement as claimed in claim 2, characterized in that the correcting means (46, 50, 56, 58) for the display means comprise at least one gear (58) mating directly with said cannon pinion (38).

4. The movement as claimed in claim 2, characterized in that the mobiles of the work train (26) have their rotation axes substantially disposed on a circle (C) of diameter equal to (D+d)/2.

5. The movement as claimed in claim 2, characterized in that it additionally comprises date-display means (72), disposed on the side opposite the dial, comprising two display disks, one for tens (74), the other for units (76), the date appearing in said opening (48).

6. The movement as claimed in claim 2, characterized in that the cannon pinion (38) and the hour wheel (42) each comprises a tubular portion (38*a*, 42*a*), engaged one within the other, the tubular portion (38*a*) of the cannon pinion being positioned in the central opening (48) such as to be able to rotate freely therein.

7. The movement as claimed in claim 1, characterized in that the correcting means (46, 50, 56, 58) for the display means comprise at least one gear (58) mating directly with said cannon pinion (38).

8. The movement as claimed in claim 7, characterized in that the mobiles of the work train (26) have their rotation axes substantially disposed on a circle (C) of diameter equal to (D+d)/2.

9. The movement as claimed in claim 7, characterized in that it additionally comprises date-display means (72), disposed on the side opposite the dial, comprising two display disks, one for tens (74), the other for units (76), the date appearing in said opening (48).

10. The movement as claimed in claim 7, characterized in that the cannon pinion (38) and the hour wheel (42) each comprises a tubular portion (38*a*, 42*a*), engaged one within the other, the tubular portion (38*a*) of the cannon pinion being positioned in the central opening (48) such as to be able to rotate freely therein.

11. The movement as claimed in claim 1, characterized in that the mobiles of the work train (26) have their rotation axes substantially disposed on a circle (C) of diameter equal to (D+d)/2.

12. The movement as claimed in claim 11, characterized in that it additionally comprises date-display means (72), disposed on the side opposite the dial, comprising two display disks, one for tens (74), the other for units (76), the date appearing in said opening (48).

13. The movement as claimed in claim 11, characterized in that the cannon pinion (38) and the hour wheel (42) each comprises a tubular portion (38*a*, 42*a*), engaged one within the other, the tubular portion (38*a*) of the cannon pinion being positioned in the central opening (48) such as to be able to rotate freely therein.

14. The movement as claimed in claim 11, characterized in that the energy source is mechanical, formed by a barrel (16), the time base is a balance (18), the counting device is an escapement (20), the barrel (16) and the balance (20) pivoting on axes substantially disposed on said circle (C).

15. The movement as claimed in claim 14, characterized in that it additionally comprises date-display means (72), disposed on the side opposite the dial, comprising two display disks, one for tens (74), the other for units (76), the date appearing in said opening (48).

16. The movement as claimed in claim 14, characterized in that the cannon pinion (38) and the hour wheel (42) each comprises a tubular portion (38*a*, 42*a*), engaged one within the other, the tubular portion (38*a*) of the cannon pinion being positioned in the central opening (48) such as to be able to rotate freely therein.

17. The movement as claimed in claim 1, characterized in that it additionally comprises date-display means (72), disposed on the side opposite the dial, comprising two display disks, one for tens (74), the other for units (76), the date appearing in said opening (48).

18. The movement as claimed in claim 17, characterized in that the cannon pinion (38) and the hour wheel (42) each comprises a tubular portion (38*a*, 42*a*), engaged one within the other, the tubular portion (38*a*) of the cannon pinion being positioned in the central opening (48) such as to be able to rotate freely therein.

19. The movement as claimed in claim 1, characterized in that the cannon pinion (38) and the hour wheel (42) each comprises a tubular portion (38*a*, 42*a*), engaged one within the other, the tubular portion (38*a*) of the cannon pinion being positioned in the central opening (48) such as to be able to rotate freely therein.

20. The movement as claimed in claim 19, characterized in that the motion work mobile (36) and the toothings of the cannon pinion (38) and of the hour wheel (42) are disposed on the bottom side of the frame, the tubular portion (38*a*) of the cannon pinion is defined by an internal diameter and by an external diameter, its external diameter being slightly less than d so allowing it to rotate freely in said opening (48), and in that the tubular portion (42*a*) of the hour wheel is defined by an external diameter slightly less than the internal diameter of the tubular portion (38*a*) of the cannon pinion, such that the hour wheel (42) can rotate freely therein.

21. The movement as claimed in claim 20, characterized in that the tubular portion (42*a*) of the hour wheel serves as accommodation for an object.

22. The movement as claimed in claim 21, characterized in that said object is chosen from amongst a lens (70), a precious stone (66) and a compass (64).

23. The movement as claimed in claim 7, characterized in that the motion work mobile (36) and the toothings of the cannon pinion (38) and of the hour wheel (42) are disposed on the dial side of the frame (10), the tubular portion (38*a*) of the cannon pinion is defined by its external diameter, a first part of which is engaged in said opening (48), the external diameter being slightly less than d so allowing it to rotate freely therein, and a second part of which, disposed outside the opening, is intended to bear the minute hand (40) and has the hour wheel (42) engaged on it.

24. The movement as claimed in claim 23, characterized in that the tubular portion (42*a*) of the hour wheel serves as accommodation for an object.

25. The movement as claimed in claim 24, characterized in that said object is chosen from amongst a lens (70), a precious stone (66) and a compass (64).

* * * * *